US007815386B2

(12) United States Patent
Sogaro

(10) Patent No.: US 7,815,386 B2
(45) Date of Patent: Oct. 19, 2010

(54) DEVICE FOR STORING AND EXTRUSION OF A FLOWABLE SUBSTANCE

(75) Inventor: Alberto C. Sogaro, Kronberg (DE)

(73) Assignee: Dentaco Dentalindustrie-und Marketing GmbH, Bad Homburg (DE)

( * ) Notice: Subject to any disclaimer, the term of this patent is extended or adjusted under 35 U.S.C. 154(b) by 1132 days.

(21) Appl. No.: 11/485,859

(22) Filed: Jul. 13, 2006

(65) Prior Publication Data

US 2007/0014623 A1 Jan. 18, 2007

(30) Foreign Application Priority Data

Jul. 15, 2005 (EP) ..... 05015478

(51) Int. Cl.
*A46B 11/00* (2006.01)

(52) U.S. Cl. ..... 401/125; 401/123; 401/44

(58) Field of Classification Search ..... 401/44–47, 401/118, 123, 125, 126–130
See application file for complete search history.

(56) References Cited

U.S. PATENT DOCUMENTS

| | | | | |
|---|---|---|---|---|
| 6,105,761 | A | 8/2000 | Peuker et al. | |
| 6,450,717 | B1 * | 9/2002 | Salz et al. | 401/125 |
| 6,503,013 | B2 * | 1/2003 | Strauss | 401/123 |
| 6,612,767 | B2 * | 9/2003 | Muller | 401/130 |
| 7,131,784 | B2 * | 11/2006 | Lee et al. | 401/128 |

FOREIGN PATENT DOCUMENTS

| | | |
|---|---|---|
| EP | 0 895 943 B1 | 4/2001 |

* cited by examiner

*Primary Examiner*—David J Walczak
(74) *Attorney, Agent, or Firm*—Quarles & Brady LLP

(57) ABSTRACT

A device for the storage and extrusion of a flowable substance (A) includes a loading unit (13) for an application tool (14). The loading unit has a pot-shaped insert (15) for a holder (17). Through axial pressure on the holder (17) the flowable substance A can be extruded from a chamber (12) of the holder through openings (20A) made on the perimeter of the insert (15) into a chamber (16) of the loading unit (13), so that the application tool (14) set at right angles to the axis of the insert (15) is loaded with the substance (A).

12 Claims, 3 Drawing Sheets

DEVICE FOR STORING AND EXTRUSION OF A FLOWABLE SUBSTANCE

CROSS REFERENCES TO RELATED APPLICATIONS

This application claims the priority benefit of European Patent Application No. 05 015 478.0 filed on Jul. 15, 2005.

STATEMENT REGARDING FEDERALLY SPONSORED RESEARCH

Not Applicable.

TECHNICAL FIELD

The invention relates to a device for the storage and extrusion of a flowable substance, and in particular to a device including at least one first chamber for receiving the flowable substance, a substantially rod-shaped application tool, and at least one second chamber for loading the application tool with the flowable substance, whereby through externally applied pressure a connection between the first chamber and the second chamber (16, 116A, 116B, 42) is created.

DESCRIPTION OF THE BACKGROUND ART

A device for the storage and extrusion of a flowable substance is known from EP 0 895 943 B1 and comprises a holder formed by two foils that create a first chamber to receive the substance and a separate second chamber for the supply of the substance into an application tool. By exerting an external pressure on the foils, a set breaking point between the two foils can be broken to create a connection between the two chambers and load the application tool with the substance. In this device, however, a problem arises that the pressure to create the connection between the two chambers can be applied only in a very focused manner, otherwise adequate hydraulic pressure to break the two foils in the transition area between the two chamber would not be available.

SUMMARY OF THE INVENTION

The object of the invention is to fashion a simple and reliably operating device for the storage and extrusion of a flowable substance of the sort named in the introduction. This object is achieved in one embodiment of the invention by providing a device including a first chamber of a pot-shaped holder is created, which has a radial, inwardly projecting, sealing collar in the area of its inner peripheral wall, and a second chamber consisting of a loading unit, which comprises a pot-shaped insert placed in the holder, the base of which delimits the first chamber, and which has at least one radial opening created in its peripheral wall. The holder and the insert can be brought together through coaxial telescoping action, starting from a closed storage position and leading to an open release position. In the closed storage position, the base of the insert is distanced from the base of the holder and the collar stands in a sealing position on the insert in such a manner that the connection between the first chamber and the radial opening of the insert is closed. In the open release position, as a result of the telescoping movement, the base of the insert is displaced in the direction of the base of the holder in such a manner that, because of the reduction of the first chamber size, the substance contained in the first chamber is extruded through the radial opening into the second chamber to load the application tool. The rod-like application tool is set substantially at right angles to the axis of the insert and of the holder.

The device incorporating the present invention is distinguished through its user-friendliness, since the unit consisting of the holder and loading unit can be held simply between the index finger and thumb of one hand and then activated through application of pressure and, after loading the substance, the substantially rod-shaped application tool can be ergonomically and comfortably separated from the other part of the device and activated with the other hand because of its right-angled inclination to the telescopic axis. In addition, in the device according to the invention, the application tool is separated from the substance prior to the activation of the system. This prevents the application tool from being qualitatively compromised through prolonged loading contact with the substance.

Advantageously, a device incorporating the present invention can be used for multiple purposes, and is particularly suitable for use in the dental field. The flowable substance is in particular a liquid. The application tool is, by way of example, a painting brush or a bristle brush such as a "microbrush." In a preferred embodiment of a device incorporating the present invention, a protective shell is designed that delimits the second chamber. The protective shell is, for example, made of foil, such as a PE-coated aluminum foil.

In a special embodiment, the protective shell is formed in the manner of a blister pack including a vacuum-formed segment and a cover foil whereby an assembly formed by the holder and the loading unit is placed in a pot-shaped container of vacuum-formed foil.

The protective shell can be used to hold the application tool and can be designed to be tearable or peelable, so that the application element loaded with the flowable substance can be easily removed from the protective shell. In particular, if the foil forming the protective shell are tearable or peelable, the loading unit can also form a dipping basin or unit for the application tool, so that the latter can be dipped multiple times in the substance contained in the loading unit after activation of the device.

To ensure stable seating of the application tool, the loading unit can include a support surface for the application tool at right angles to the axis of the insert and of the holder. For example, the support surface is formed by a stem-like projection of the loading unit.

To secure the application tool laterally, the support surface can have a groove-like cross-section. Alternatively, the application tool can also be inserted in a tubular section of the radial loading unit. The tubular section secures the application tool radially.

If the flowable substance to be applied via the application tool is a multi-component system, it is beneficial if the loading unit has at least two inserts, each of which works in conjunction with a holder. Prior to activation, a component of the compound is supplied to each holder. The components are then blended together in the loading unit after its activation.

It is also feasible, in the case of a multi-component system, to provide at least one insert to supply a liquid component to the holder designed for it and another component, particularly a powder component, to the loading unit. Upon activation of the system the liquid flows from the chamber of the holder into the chamber of the loading unit. There it blends with the powder.

The inserts can be arranged alongside each other and have parallel axes or also can be arranged coaxially and superimposed on one other. To secure the system in the storage position, the insert can have a ring groove cooperating with the collar of the holder to define the closed storage position.

A further special embodiment of the device according to the invention can be designed so that it has, for example, a wall-like separation device that separates the application tool from a loading space in the loading unit and is divided or penetrated by the application tool to load the application tool with the pertinent substance. The separation device can be formed from the loading unit or also from the protective shell.

Further advantages and advantageous embodiments of the object according to the invention are to be found in the description, drawings, and patent claims.

BRIEF SUMMARY OF THE DRAWINGS

Three exemplary embodiments of the device according to the invention are illustrated in the form of a simplified diagram and will be further explained in the following description.

DETAILED DESCRIPTION OF THE PREFERRED EMBODIMENTS

FIG. 1 to 4 illustrate a device 10 for the storage and extrusion of a flowable substance A, which is contained in a chamber 12 in the deactivated position shown in the diagram and which can be used for application in the field of dentistry, for example.

Figure 4:
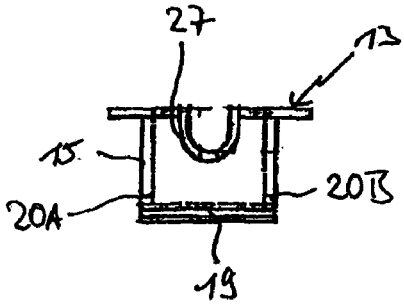
FIG. 4 shows a front view of the loading unit.

The device 10 comprises a loading unit 13 showing a plastic injection-molded part for loading an application tool 14 designed as a so-called microbrush. The loading unit 13 has a pan-like shape and includes a stem-shaped storage area 27 comprising a support surface for the application tool 14, as well as, a pot-shaped insert 15. The insert 15 has a substantially cylindrical peripheral surface and encloses a chamber 16 for loading the application tool 14 with the substance A. As shown in FIG. 4, the stem-shaped storage area 27 has a substantially grooved cross-section, so that the rod-shaped application tool 14 is secured laterally.

Figure 1:
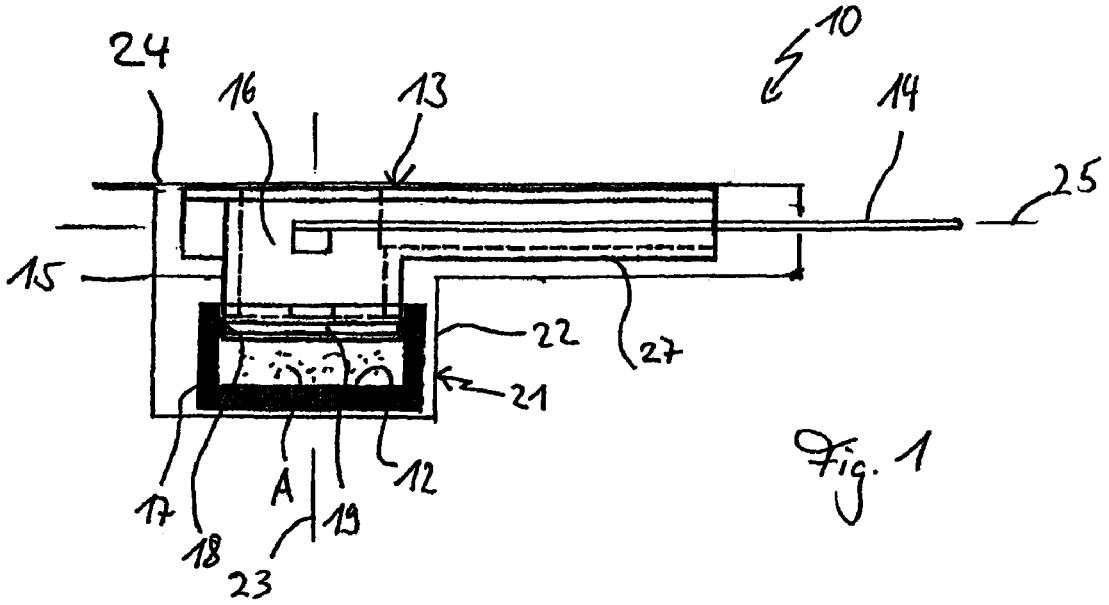
FIG. 1 shows a section through a device designed for storage and delivery.
Figure 2:
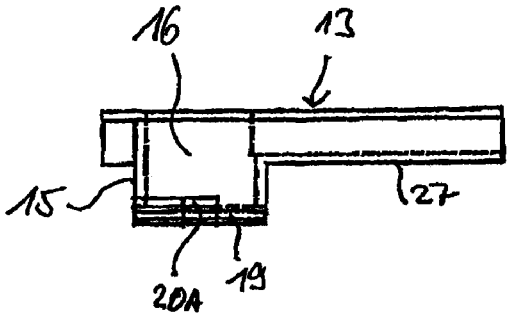
FIG. 2 shows a loading unit of the device according to FIG. 1 as a stand-alone object.
Figure 3:
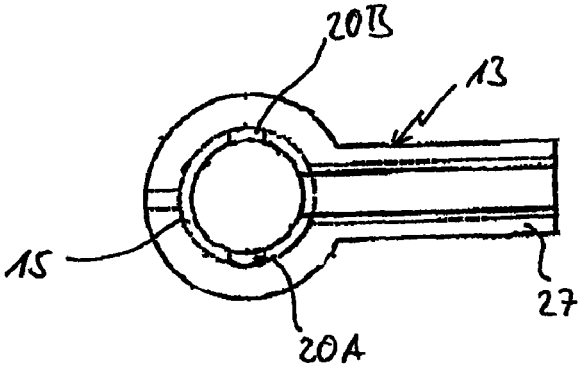
FIG. 3 shows a top view of the loading unit.

The insert 15 extends into a likewise pot-shaped holder 17 that encloses the chamber 12 for supplying the flowable substance A and which has a radial, inwardly projecting, sealing collar 18, such as an O-ring, in the area of its inner wall. The collar sealingly engages a ring groove 19 created on the perimeter of the insert 15 of the loading unit 13 in the closed storage position, as shown in FIG. 1, whereby a closed storage position is produced in which no connection exists between the chamber 12 of the holder 17 and the chamber 16 of the loading unit 13. Although a sealing collar, such as an O-ring is disclosed, any means for preventing fluid communication between the first and second chambers in the closed storage position can be used, such as a toroidal seal, and the like, without departing from the scope of the invention.

The insert 15 on the perimeter has two openings 20A and 20B. Preferably, the openings 20A and 20B are radial openings above the ring groove 19 and create a connection between the chamber 12 of the holder 17 and the chamber 16 of the insert 15 after activation of the device 10, so that the flowable substance A can flow from chamber 11 into chamber 16 through the openings 20A and 20B.

The loading unit 13, the holder 17, and the application tool 14 are received in a protective shell 21 that delimits the second chamber 16. Preferably, the protective shell 21 is a vacuum-formed aluminum base foil that produces a bowl-shaped container and an aluminum cover foil 24 coated with PE.

To activate the device 10, the user takes the device 10 between an index finger and a thumb of one hand. Then pressure is exerted on the base of the holder 17 and on the side of the loading unit 13 opposite the base so that the holder is moved along a telescopic axis 23 in the direction of the insert 15 and a connection is created between chambers 12 and 16 through the openings 20A and 20B. The insert 15 in this situation acts in the manner of a piston, so that the flowable substance A contained in the chamber 12 is extruded through the openings 20A and 20B into chamber 16 of the insert 15 and the application tool 14 is loaded with the substance A. Next, when gripped with the other hand, the application tool loaded with the substance A can be withdrawn from the protective foil 21 along a longitudinal axis 25 defined by the application tool 14 set substantially at a right angle to the telescopic axis 23 of the insert 15 and holder 17 and in parallel with the course of the stem-shaped storage area 27, and used for applying the substance A.

Figure 5:
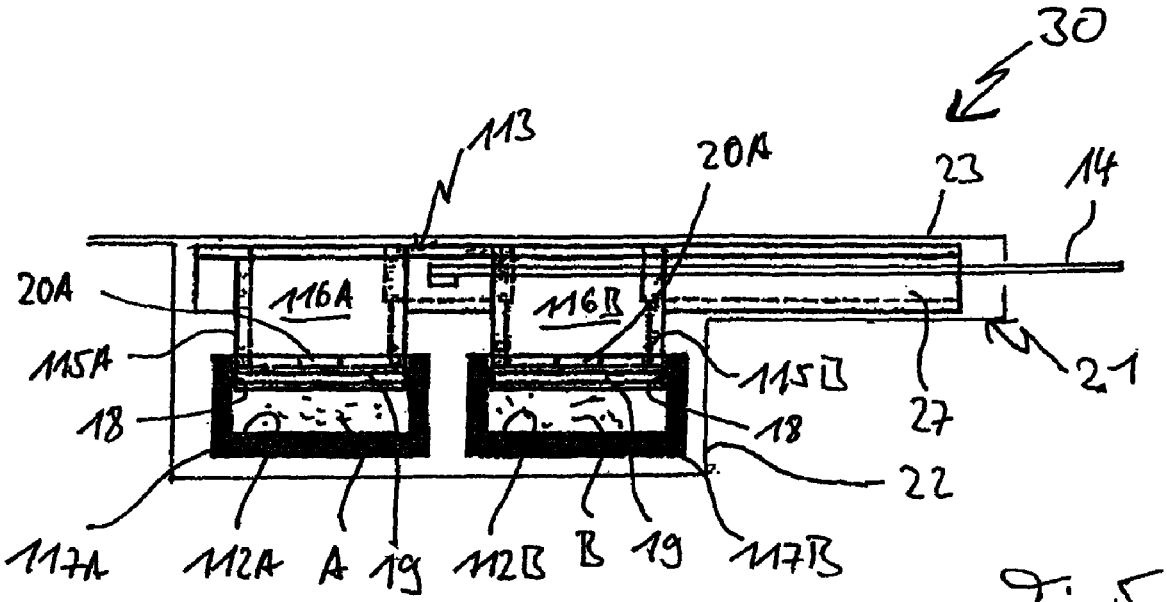
FIG. 5 shows a section through a storage and delivery device with a two-component system according to the invention.
Figure 6:
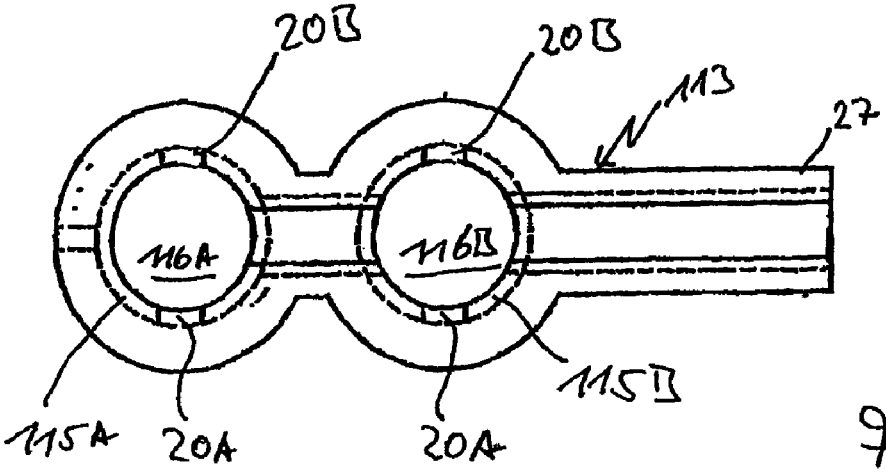
FIG. 6 shows a top view of a loading unit of the device according to FIG. 5.

FIGS. 5 and 6 show a device 30 for the storage and extrusion of a flowable substance that is designed for a multi-component system. The device 30 comprises a loading unit 113 has the shape of a double pan that has two side-by-side inserts 115A and 115B. The inserts 15A and 115B are each designed in the manner of the insert 15 of the embodiment shown in FIGS. 1 to 4, and each insert 115A and 115B work in conjunction with a holder 117A or 117B, respectively. The holders 117A and 117B likewise resemble the holder 17 of the device 10 shown in FIGS. 1 to 4.

Prior to activation of the device 30, a first component A of a compound is placed in the holder 117A and a second component B of the compound is placed in the holder 117B. Activation follows the process for the activation of the device 10 shown in FIGS. 1 to 4, whereby first of all, axial pressure is exerted on the holder 117A in the device 30 to extrude the component A through the radial openings 20A and 20B of the insert 115A into chamber 116A of the loading unit 113 and then axial pressure is exerted on the holder 117B to extrude the substance B through the radial openings 20A and 20B of the insert 115B into chamber 116B of the loading unit 113. Since the two chambers 116A and 116B are linked to each other, the two components A and B can blend with each other. An application tool 14 is thereby loaded with the component mixture. Then the application tool 14 can be withdrawn from a protective shell 21 of the device 30 and used for the particular purpose in hand.

As for the other features, the construction and function correspond to the construction and function of the embodiment example shown in FIGS. 1 to 4.

Figure 7:
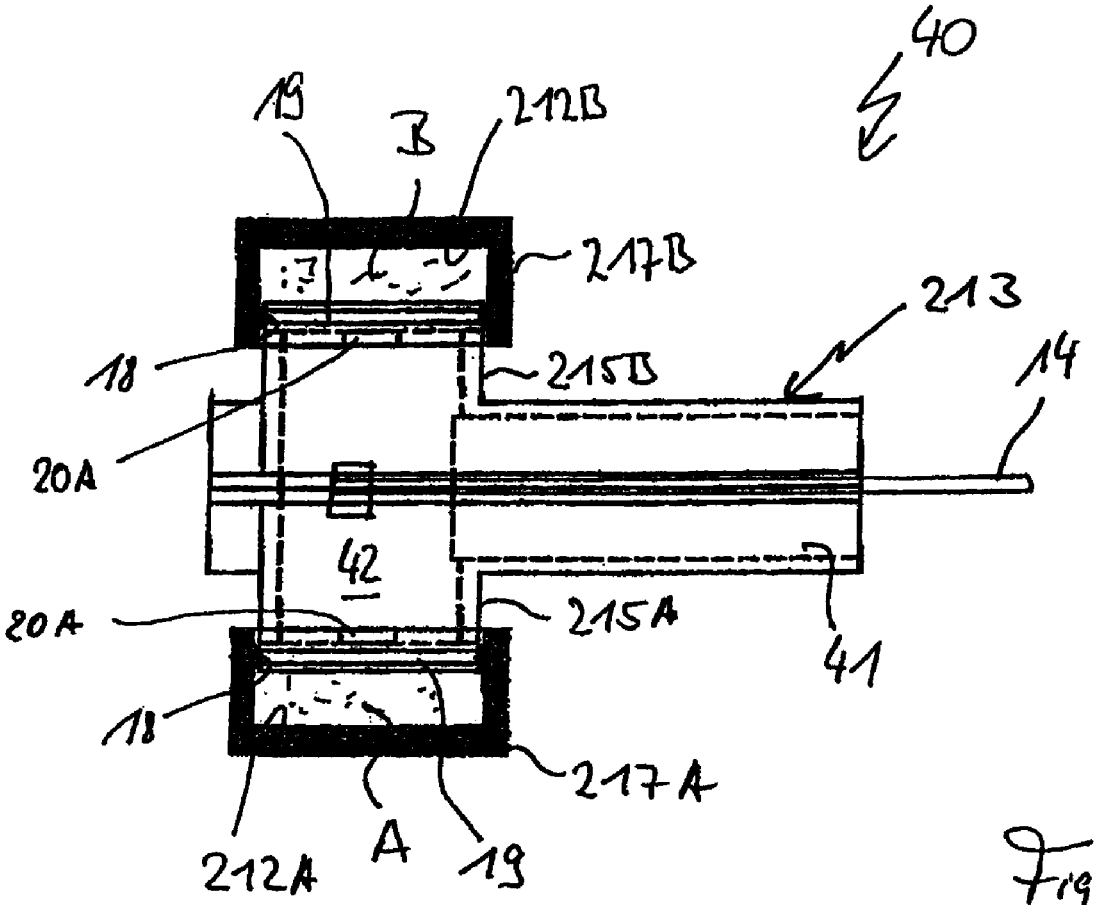
FIG. 7 shows a section through an alternative embodiment of a storage and delivery device for a two-component system.

FIG. 7 illustrates a further embodiment of a device for the storage and extrusion of a flowable substance. Just as in the exemplary embodiment shown in FIGS. 5 and 6, the device 40 is useful for the storage, mixing, and application of a two-component system. The device 40 comprises for this purpose a loading unit 213 for a microbrush 14. The loading unit 213 likewise has two inserts 215A and 215B, each of which corresponds to the insert 15 of the device 10 as shown in FIGS. 1 to 4 and works in conjunction with a holder 217A and 217B of the kind shown in FIG. 1.

In addition, the loading unit 213 has a tubular and stem-shaped guide and storage place 41 for the application tool 14. The inserts 215A and 215B are aligned in a mirror image-like arrangement with regard to each other.

To activate the device 14, pressure is exerted on the holders 217A and 217B by the index finger and thumb of one hand, whereby the substances A and B contained in the two holders are extruded into a mixing and loading area 42 of the loading unit 41, so that the application tool 14 is loaded with the substance mixture.

While there has been shown and described what are at present considered the preferred embodiments of the invention, it will be obvious to those skilled in the art that various changes and modifications can be made therein without departing from the scope of the invention defined by the appended claims.

I claim:

1. A device for the storage and extrusion of a flowable substance, said device comprising:

at least one first chamber to receive the flowable substance;

a substantially rod-shaped application tool;

at least one second chamber for loading the application tool with the flowable substance, whereby through externally applied pressure, a connection between the first chamber-and the second chamber is achievable, wherein the first chamber is formed by a pot-shaped holder having a radial, inwardly projecting, sealing collar on an inner peripheral wall of said holder, the second chamber is formed by a loading unit including a pot-shaped insert inserted into the holder, a base of said insert delimits the first chamber and on a peripheral wall of said insert at least one radial opening is formed, the holder and the insert are capable of being brought together through coaxial telescopic action along a telescopic axis of the insert and of the holder, starting from a closed storage position and leading to an open release position, in the closed storage position the base of the insert is distanced from a base of the holder, and the collar is positioned in a sealing manner on the insert such that a connection between the first chamber and the radial opening of the insert is closed, in the open release position, as a result of the telescopic action, the base of the insert is moved in the direction of the base of the holder such that through reduction of the size of the first chamber the substance contained in the first chamber is extruded through the radial opening into the second chamber for loading of the application tool, and a longitudinal axis of the rod-shaped application tool is set substantially at a right angles to the telescopic axis of the insert and of the holder.

2. The device according to claim 1, in which a protective shell delimits the second chamber.

3. The device according to claim 2, in which the protective shell is formed by a vacuum-formed part and a cover foil.

4. The device according to claim 1, in which the loading unit comprises a support surface for the application tool set at right angles to the axis of the insert and of the holder.

5. The device according to claim 4, in which the support surface is formed by a stem-shaped projection of the loading unit.

6. The device according to claim 5, in which the stem-shaped projection has a grooved cross-section.

7. The device according to claim 1, in which the application tool is inserted into a tubular section of the loading unit.

8. The device according to claim 1, in which the loading unit has at least two inserts, each of which works in conjunction with a holder.

9. The device according to claim 8, in which the inserts are arranged alongside each other and have parallel axes.

10. The device according to claim 8, in which the inserts are arranged coaxially and superimposed on one other.

11. The device according to claim 1, in which the insert has a ring groove for definition of the closed storage position, which groove cooperates with the collar of the holder.

12. A device for the storage and extrusion of a flowable substance, said device comprising:

at least one first chamber for receiving the flowable substance, said at least one first chamber including a holder having a radial, inwardly projecting sealing collar;

an application tool having a longitudinal axis; and at least one second chamber for loading the application tool with the flowable substance, said second chamber including a loading unit having an insert telescopically received in the holder and having at least one radial opening, said insert being movable relative to said holder along a telescopic axis between a closed storage position and an open release position, in the closed storage position, the collar sealingly engages the insert such that a connection between the first chamber and the radial opening of the insert is closed, in the open release position, as a result of the telescopic action, the insert is further inserted into the holder forcing the substance contained in the first chamber through the radial opening into the second chamber for loading of the application tool, said longitudinal axis being substantially at a right angle to the telescopic axis.

* * * * *

UNITED STATES PATENT AND TRADEMARK OFFICE

CERTIFICATE OF CORRECTION

PATENT NO. : 7,815,386 B2
APPLICATION NO. : 11/485859
DATED : October 19, 2010
INVENTOR(S) : Sogaro It is certified that error appears in the above-identified patent and that said Letters Patent is hereby corrected as shown below:

Column 4, line 36 “15A” should be changed to -- 115A --
Column 6, Claim 1, Line 2 “angles” should be changed to -- angle --

Signed and Sealed this
Twenty-fifth Day of January, 2011

David J. Kappos

David J. Kappos
*Director of the United States Patent and Trademark Office*